US006209275B1

(12) United States Patent
Cates et al.

(10) Patent No.: US 6,209,275 B1
(45) Date of Patent: Apr. 3, 2001

(54) CLEANROOM WALL SYSTEM

(75) Inventors: Dennis O. Cates, Tualatin; Roger K. Crawford, Salem, both of OR (US)

(73) Assignee: Southland Industries, Long Beach, CA (US)

( * ) Notice: Subject to any disclaimer, the term of this patent is extended or adjusted under 35 U.S.C. 154(b) by 0 days.

(21) Appl. No.: 09/285,640

(22) Filed: Apr. 2, 1999

Related U.S. Application Data

(60) Provisional application No. 60/093,349, filed on Jul. 20, 1998.

(51) Int. Cl.[7] ..... E04C 1/00

(52) U.S. Cl. ..... 52/283; 52/762

(58) Field of Search ..... 52/283, 762, 36.1, 52/300, 465, 467, 468, 716.8, 717.06, 718.02, 731.9, 733.1, 733.2, 800.18

(56) References Cited

U.S. PATENT DOCUMENTS

| | | |
|---|---|---|
| 3,057,444 | 10/1962 | Walberg . |
| 3,513,606 | 5/1970 | Jones . |
| 3,566,561 | 3/1971 | Tozer . |
| 4,270,332 | 6/1981 | Montrouil . |
| 4,625,483 | 12/1986 | Zacky . |
| 4,984,400 | 1/1991 | Bockmiller . |
| 5,140,792 | 8/1992 | Daw . |
| 5,228,254 | 7/1993 | Honeycutt, Jr. . |
| 5,307,600 | 5/1994 | Simon, Jr. . |
| 5,414,967 | 5/1995 | Cates . |
| 5,634,300 | 6/1997 | Huebner . |
| 5,806,261 | 9/1998 | Huebner . |

OTHER PUBLICATIONS

*Bosch Aluminum Structural Framing System*, Catalog, Sep. 1997, pp: cover, 1–0 through 1–7, 2–0 through 2–4, 2–22, 2–26, 2–27, 2–40, 2–42, 2–46, 2–48, 3–16 through 3–24, 3–24, 3–30, 3–31, 4–1 through 4–5, 6–1, 6–8, 6–9, 9–0, and 9–4.

Item Prducts, Inc. Catalog, *T–Slot Nut Zn* p. 20–007, circa Jan. 1998.

Unistrut Clean Room Systems, Catalog, UCR200; 2 pages, circa Jan. 1992.

Unistrut Clean Room Systems, Catalog, UCR240; 2 pages, circa Jan. 1992.

Unistrut Clean Room Systems, Catalog, UCR280; 2 pages, circa Jan. 1992.

Unistrut Clean Room Systems, Catalog, *Channel Nuts & End Caps*; 1 page, circa Jan. 1992.

LSI Cleanrooms, Catalog, LSI 300; 1 page, circa Jan. 1998.

LSI Cleanrooms, Catalog, LSI 500; 1 page, circa Jan. 1998.

*Primary Examiner*—Beth A. Stephan
(74) *Attorney, Agent, or Firm*—ipsolon llp

(57) ABSTRACT

Construction and remodeling of a cleanroom wall system is facilitated with a universal stud design. A variety of wall configurations may be assembled with the same stud. Also provided is a useful connector block for joining perpendicularly oriented studs, or for splicing together axially aligned studs. A corner stud is also provided, as well as a deflection track for connecting the top track of a wall panel to a conventional ceiling grid to allow deflection of the grid relative to the wall and to facilitate easy access to the portion of the ceiling immediately above the wall panel.

16 Claims, 11 Drawing Sheets

Fig. 16
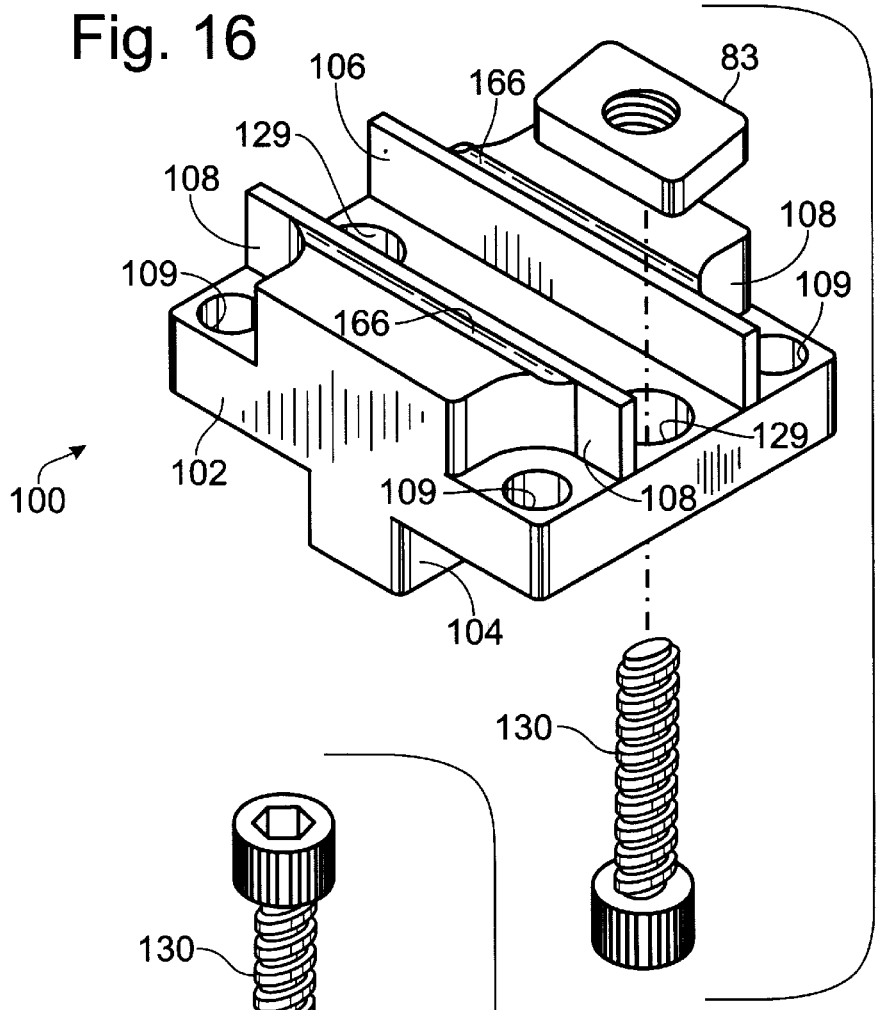
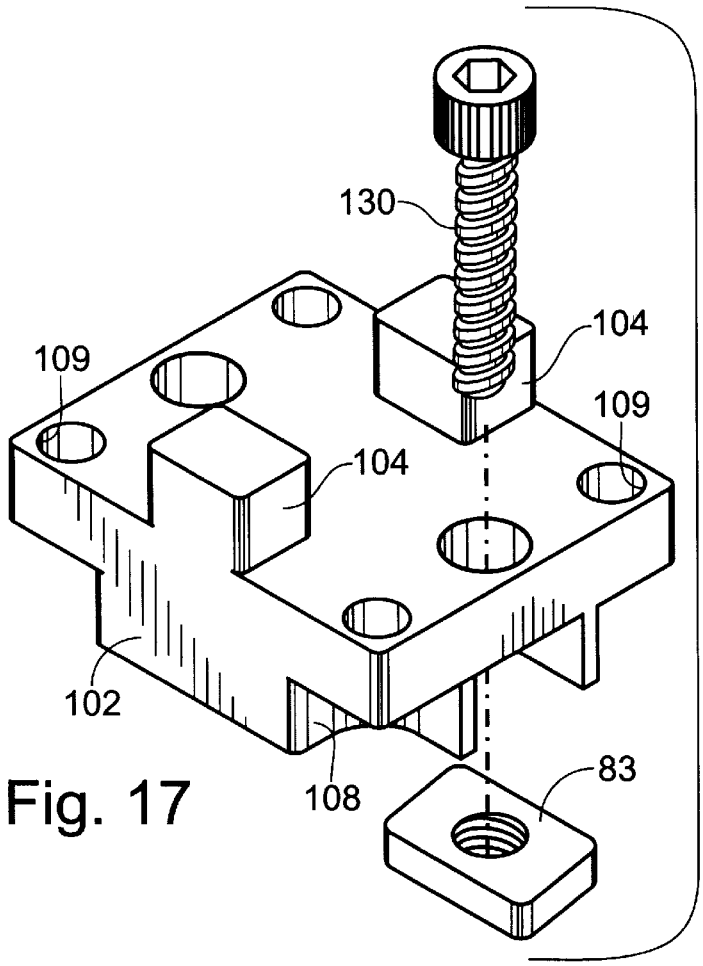
Fig. 17

CLEANROOM WALL SYSTEM

This application claims the benefit of U.S. provisional application No. 60/093,349 filed Jul. 20, 1998.

TECHNICAL FIELD

This invention relates to the configuration and assembly of components that make up a wall system that is particularly well adapted for cleanrooms.

BACKGROUND OF THE INVENTION

Cleanrooms are commercial spaces that are constructed and maintained in a way that keeps the room free of contaminants that might otherwise interfere with the precision work undertaken there. Cleanrooms are used, for example, in the production of certain electronics and computer components.

The components of a cleanroom wall system generally include studs to which wall panels are fastened. A framework of vertical studs and interconnected horizontal studs provides sufficient stability to the overall wall system. The wall panels may be arranged in a number of ways. For instance, the panel may be a relatively thick member (hereafter referred to as a "thick" panel) that matches the nominal wall thickness and that may exceed or equal the width of the studs to which it is fastened. Alternatively, a pair of thin, spaced apart panels (spaced to match the nominal wall thickness and referred to as a "double sided wall") may be fastened to the studs.

In yet another arrangement, single, thin-wall panels are fastened to one ide of the studs, and the opposite sides of the studs are exposed. In this "single-sided wall" arrangement, it is often necessary to provide the same nominal wall thickness as provided by the previously mentioned arrangements.

In recent years the use of cleanrooms has increased dramatically. Moreover, existing cleanrooms often require rearrangement or remodeling to accommodate changes made in the production systems that are inside or adjacent to the cleanroom. Such construction and remodeling needs are best met with cleanroom wall system components that, as a result of their configuration, minimize the time and costs associated with construction and assembly of the wall system.

SUMMARY OF THE INVENTION

The present system provides a cleanroom wall system that includes a stud component that, owing to its universal configuration, permits use of the stud with a variety of wall panel arrangements.

The stud is designed to carry a batten that is easily and securely aligned with the stud and serves to secure the wall panel to the stud.

A connector block is also provided. The connector block is shaped for mounting on the end of a horizontally oriented stud and for connection with a vertical stud in a manner that ensures a stiff connection between the two studs. Moreover, a pair of connector blocks is employed for splicing together two axially aligned studs, such as two parts of a vertically oriented stud. The splicing aspect of the connector block enables simple construction and remodeling of wall systems in instances where only a portion of the wall between the ceiling and floor need be changed.

Also provided is a simply designed corner stud for use with the universal wall studs of the present invention.

Moreover, a novel deflection track assembly is provided for connecting the top track of a wall panel to a conventional ceiling grid to allow deflection of the grid relative to the wall panel and to facilitate access to the portion of the ceiling above the wall panel.

DESCRIPTION OF THE DRAWINGS

FIG. 16 is a perspective view of one side of a connector block formed in accordance with the present invention.

FIG. 17 is a perspective view of the opposite side of the connector block of FIG. 16.

DESCRIPTION OF A PREFERRED EMBODIMENT

Figure 1:
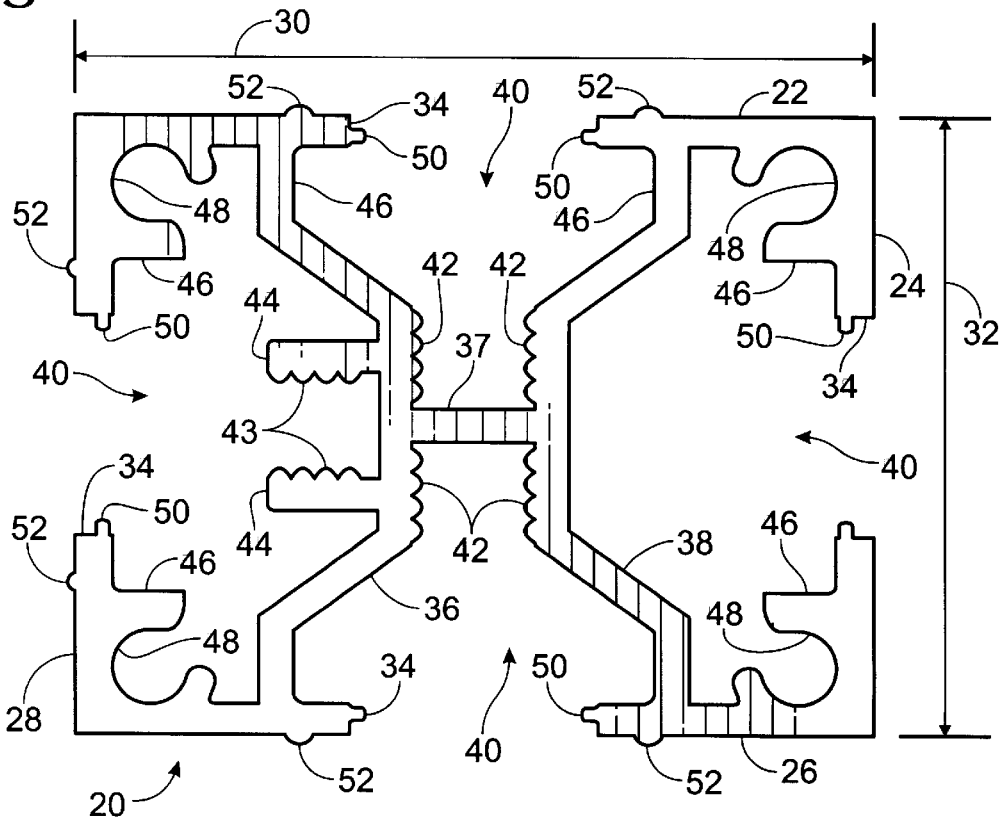
FIG. 1 is an end view of a stud component of a wall system formed in accordance with the present invention.

A preferred embodiment of a stud 20 formed in accordance with the present invention is shown in a greatly enlarged end view, FIG. 1. The stud 20 is preferably extruded aluminum. The stud is rectangular in cross section and includes outer walls 22, 24, 26, 28 sized to define a wide side of the stud, indicated by dimension 30 in the figure, and a relatively narrow side 32.

Slots 34 extend along the length of the stud to interrupt each of the four outer walls of the stud. Just inside each slot 34, inner walls 36, 38, which are continuous with the outer walls, are shaped to define a chamber 40. The chambers 40 that are continuous with the slots 34 in the opposing wide-side walls 22, 26 taper toward the center of the stud. There, the inner walls 36, 38 define two parallel portions, the facing surfaces of which that are corrugated 42 to receive a threaded fastener, as explained more below. The inner walls 36, 38 are joined at the center of the stud by a web 37 that extends in a direction generally parallel with the wide sides of the stud.

One of the inner walls 36 has a pair of extensions 44 that extend into the chamber 40 toward the outer wall 28. Those extensions have corrugated inner facing surfaces 43 like the surfaces 42 just described. The chamber associated with the other, narrow-side wall 24 does not include any corrugated surfaces.

Just inside the outer wall that defines each slot 34, the stud walls are shaped to define shoulders 46. For each chamber, a pair of spaced-apart, parallel shoulders are present. The shoulder pairs are spaced apart by a distance somewhat greater than the width of the slots 34 and provide surfaces against which channel nuts bear as described more fully below.

At each comer of the stud 20 the walls are shaped to define nearly closed apertures 48 that receive sheet metal screws that are used to attach a connector block as described below.

Each of the slots 34 in an outer wall has a pair of inwardly protruding ribs 50 that are slightly thinner than the walls. As a result, the outer walls have a recessed portion lining each slot 34, thereby to accommodate, when the adjacent chamber is not utilized, a cover 82 (See FIG. 4). The cover 82 seats in the slot in a manner such that the outer surface of the cover 82 is substantially flush with the outer surface of the stud wall.

A pair of ridges 52 are associated with each of the three chambers 40 that include the corrugated surfaces 42, 43. Specifically, an elongated ridge 52 extends parallel to the length of the stud (that is, normal to the plane of FIG. 1) on both sides of the slots 34. The ridges 52 mate with correspondingly shaped grooves 66 that are formed in the batten 60 (FIG. 2), which is carried on one or more of the outer walls of the stud 20 for the purpose of securing wall panels to the stud. One will appreciate that this mating could occur with a stud that carries the grooves and the batten that carries the ridges. The ridges 52 also mate with grooves formed in the connector block 100 (FIG. 3) as will be described.

Figure 2:
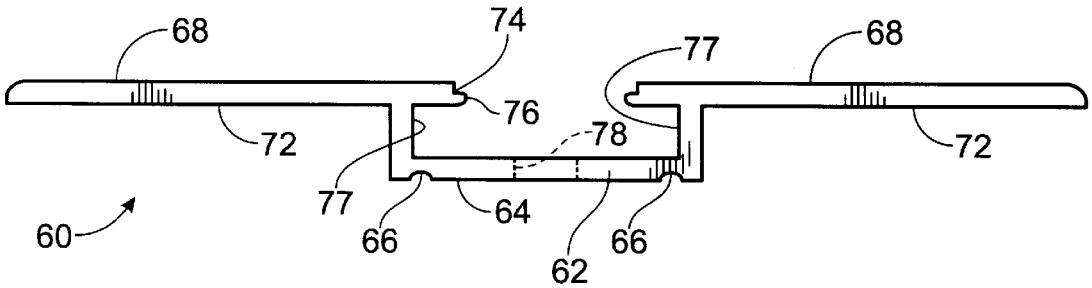
FIG. 2 is an end view of a batten component of a wall system formed in accordance with the present invention.

Turning now to FIG. 2, the batten 60 is a thin-walled, extruded aluminum member that has a generally U-shaped base 62. The underside 64 of the base rests against the outer surface of an outer wall 22, 26, 28 of the stud and includes the above-mentioned grooves 66. The grooves 66 mate with the ridges 52 on the stud thereby to facilitate correct positioning of the batten to the stud as the former is attached to the latter.

Inasmuch as the base 62 of the batten 60 rests on an outer wall of the stud 20, the overall width of a stud and batten combination represents the sum of the widths of both of those components.

The batten 60 also includes outwardly extending flanges 68. As a result, there are gaps 70 (best shown in FIG. 3) defined between the undersides 72 of the flanges of the battens and the stud outer wall to which the batten is attached. As will become clear, a wall panel or glazing may fit into this gap.

Figure 3:
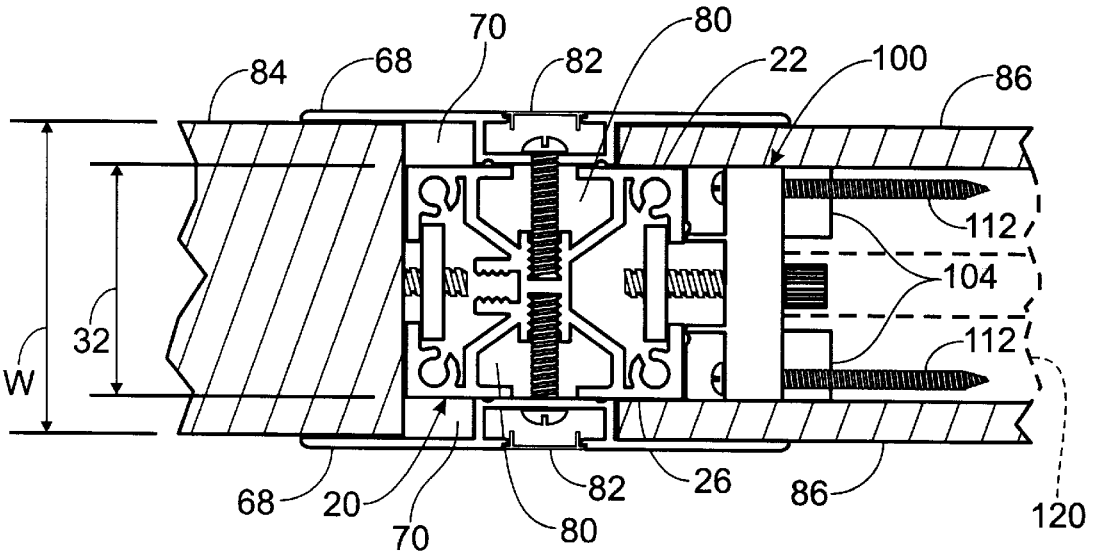
FIG. 3 is a cross sectional view of the assembled components of the system of the present invention at the junction of a horizontal stud and a vertical stud.

Holes 78 are formed through the base of the batten at spaced apart locations along the length of the batten. The holes 78 accommodate the shafts of screws 80 (FIG. 3). The screws 80 are threaded between the corrugated surfaces 42, 43 for fastening the batten to the stud.

At the center of the batten, between the flanges 68, there is defined a slot 74 that has a pair of inwardly protruding ribs 76 that match those 50 of the stud slots 34. As a result, one of the aforementioned covers 82 will also fit into and cover the batten slot 74 (See FIG. 3).

The parallel walls of the base 62 define a pair of shoulders 77. The shoulder pairs 77 are spaced apart by a distance somewhat greater than the width of the slots 74 and provide surfaces against which channel nuts bear as described more fully below.

Figure 4:
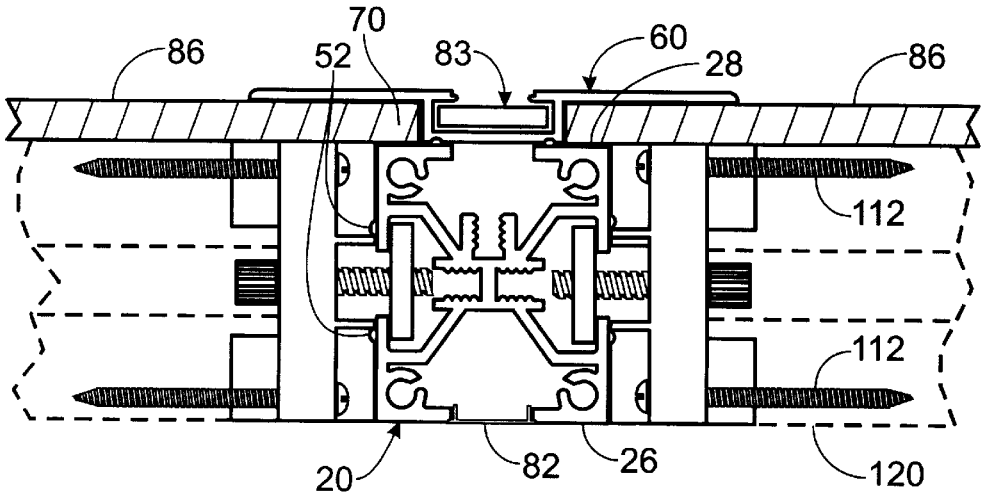
FIG. 4 is a cross sectional view of the assembled components of the system of the present invention at the junction of two horizontal studs and a vertical stud.
Figure 5:
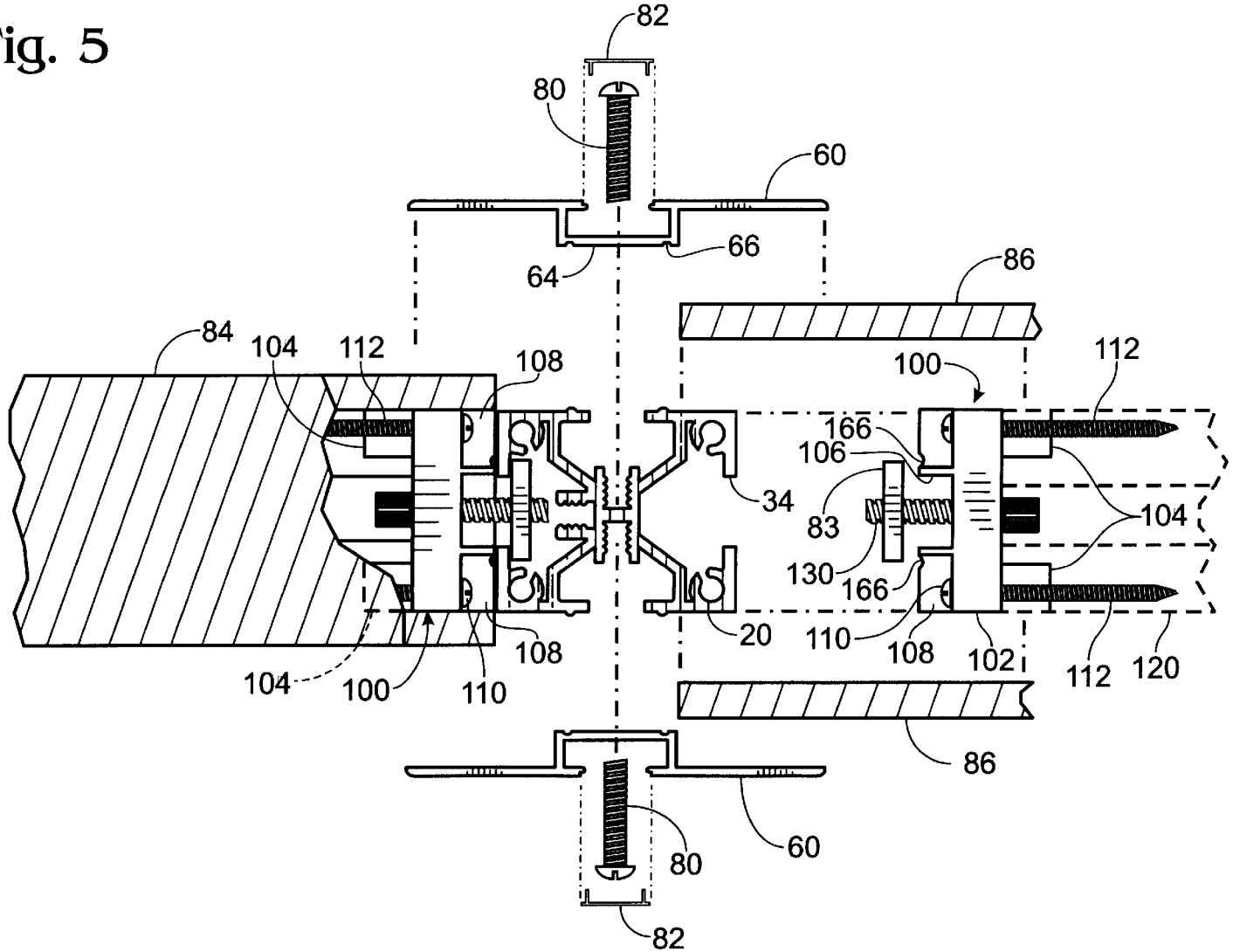
FIG. 5 is an exploded view of the assembled components of the system of the present invention at the junction of two horizontal studs and a vertical stud.
Figure 18:
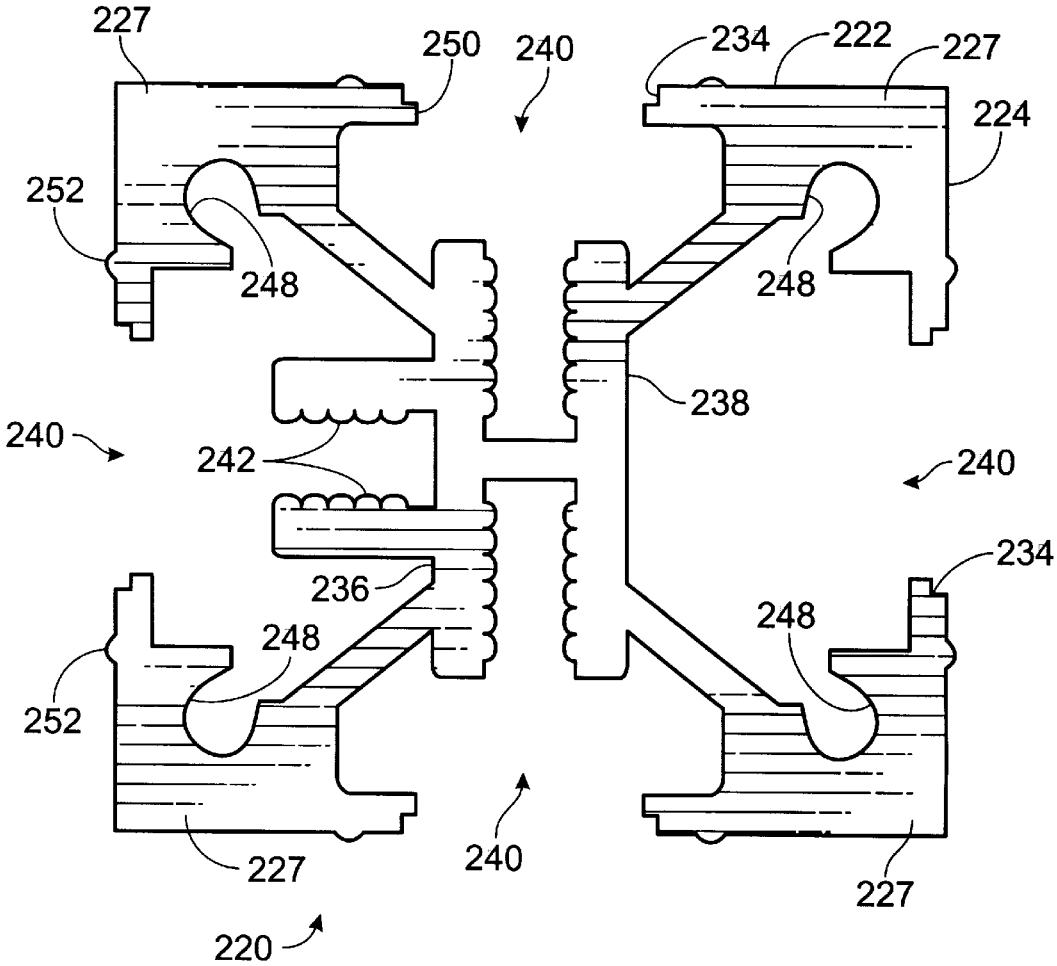
FIG. 18 is an end view of a stud component of a wall system formed in accordance with an alternative embodiment of the present invention.

It is noteworthy here that, in a few respects, the stud component appearing in FIGS. 3–5 has been simplified somewhat for the purpose of clear illustration. Reference should be made to FIGS. 1 and 18 when it is necessary to scrutinize details of the stud configuration.

FIG. 3 shows the universal stud 20 of the present invention used in one of at least three different wall configurations. In particular, the components of the system are assembled so that two battens are mounted to the stud on the opposing walls 22, 26 that define the wide side 30 of the stud 20. As a result, the overall thickness of the wall secured to the combined battens and stud (as measured between the top to bottom of FIG. 3) is the sum of the width of the stud's narrow side 32 and the width of the two gaps 70. That sum appears as dimension "W" in FIG. 3. In a preferred embodiment, this sum is a nominal wall thickness of two inches (5.08 cm).

As shown on the left side of FIG. 3, a conventional "thick" wall panel 84 fits into and is retained between the batten flanges 68. That panel abuts the stud 20. The wall panel 84 may also rest on a horizontally connected stud 120, such as shown on the right side of FIG. 3. The horizontal stud 120 has the same cross section as the above-described stud 20.

The right side of FIG. 3 shows an arrangement whereby a pair of thin, spaced apart wall panels 86 (the "double sided wall" arrangement mentioned above) are retained in the respective gaps 70 that are present between the batten flanges 68 and the outer walls 22, 26 of the stud. The connector block 100 and horizontal stud 120, which are also shown in FIG. 3, will be described below.

With respect to FIG. 3, it is noteworthy that the distance between the outermost edges of the flanges 68 of a batten (that is, measured horizontally in FIG. 3) is about 3 inches in the preferred embodiment shown. It is noted, however, that shorter-flange battens may be employed. For instance, a flange edge-to-edge distance of 2 inches would suffice, leaving an adequate extension of the flanges to secure wall panels between them.

FIG. 4 shows that, as compared to FIG. 3, the rectangular stud 20 has been rotated 90 degrees to accommodate—using the same stud design—another wall panel arrangement. This illustrates the universal aspect of the stud.

In particular, FIG. 4 shows a batten 60 mounted to the wall 28 of the stud that defines the narrow side 32 of the stud, (For illustrating how a channel nut 83 fits in both the stud and batten, the fasteners 80 that secure the batten to the stud are not shown in FIG. 4.) Only one side of the studs 20, 120 is covered with the thin-type wall panels 86, which may be, for example, 0.25 inches thick. As a result, the nominal wall thickness (here, 2 inches) is maintained even though the wall configuration calls for the "single sided wall" arrangement mentioned above.

It will be appreciated that the use of a universal stud 20, 120 to assemble at least three different wall arrangements greatly simplifies the construction and handling of the components.

FIGS. 5–8 are useful for illustrating the configuration and use of the connector block 100. One preferred connector block is shown in FIGS. 16 and 17 and is shaped for mounting on the end of a horizontally oriented stud 120 and for connection with a vertical stud in a manner that ensures a stiff connection between the two studs.

The connector block 100 includes a body 102 (FIGS. 5, 16, 17) that has a cross section that is sized to match the cross section of the stud. Thus, the outer surfaces of the connector block body are flush with the outer surfaces of the stud 120.

Figure 6:
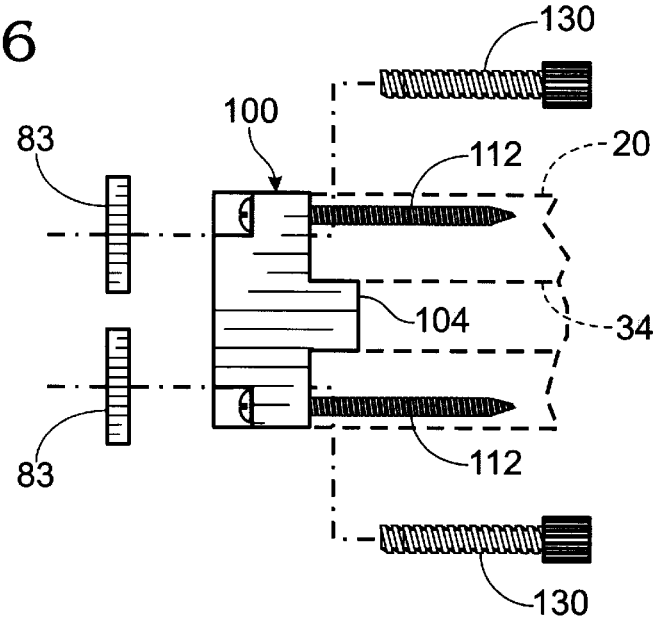
FIGS. 6–8 show in a sequence of three drawings how a connector block of the present system is connected to the end of a stud and readied for connection with another stud that is oriented perpendicular to the first stud.
Figure 15:
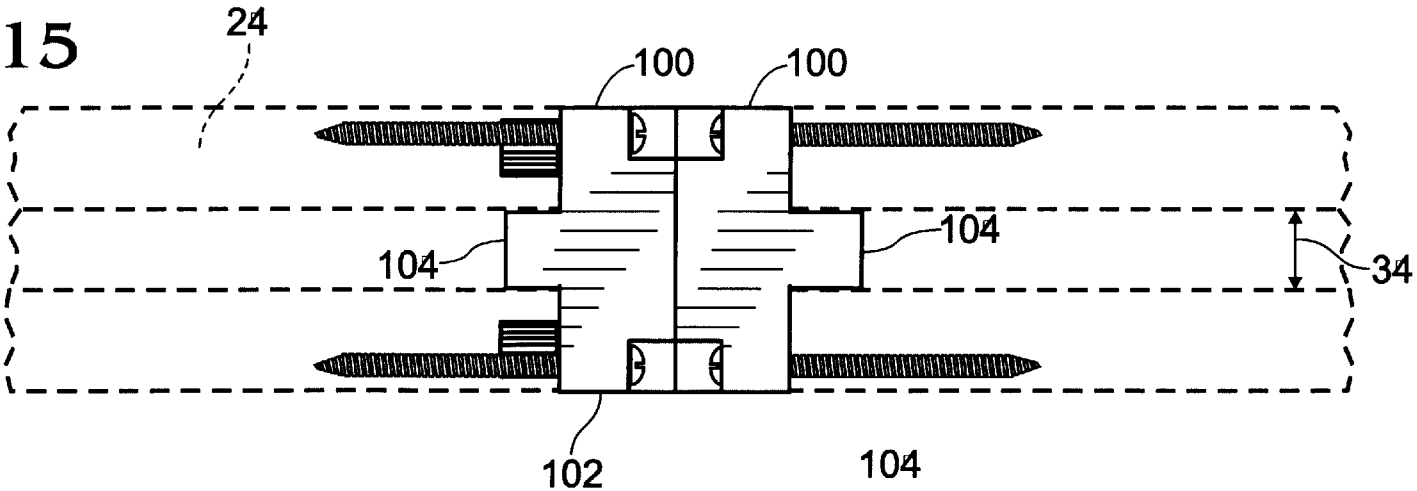
FIG. 15 is another side view, rotated 90 degrees relative to the view of FIG. 14, and showing the same spicing technique.

A pair of protrusions 104 protrudes from one side of the block body. The protrusions 104 are spaced from each other and each is shaped to slide into a chamber 40 of a stud. The outer part of each protrusion fits snugly between the opposing edges of the slot 34 of the associated chamber, as best shown in FIGS. 6 and 15. The outer surface of the protrusion 104, as well as the outer surface of the body 102 is flush with the outer surface of the stud.

A cubical cut 108 is made in each corner of the side of the block body 102 that is opposite that of the protrusions 104. The corners have holes 109 to pass sheet metal screws 112 (FIG. 5), the heads 110 of which are recessed in the cuts 108. The screws thread into the apertures 48 made in the stud as described above (FIG. 1). Thus, the screws 112 firmly attach the block 100 to the end of a stud. The snug fitting protrusions 104 in the stud slots 34 further stiffen the junction. The connection to the stud end is made with a block that is no larger in cross sectional area than that of the stud.

An elongated recess 106 is formed in the side of the connector body that is opposite the protrusions (FIG. 5). This block surface also has a pair of parallel grooves 166 that match in size and orientation the grooves 66 formed on the underside 64 of the batten 60. Thus, as best shown in FIG. 4, the connector block grooves 166 mate with the ridges 52 on the stud 20 to facilitate precise alignment of the studs when a horizontal and vertical stud are brought together for making a joint.

The connector block 100 includes two spaced-apart holes 129 to accommodate cap screws 130 (FIG. 6). The shafts of the screws 130 extend out of the block recess 106, and the heads of the screws fit into a chamber 40 in the stud when the block is fastened to the stud by the sheet metal screws 112.

Figure 7:
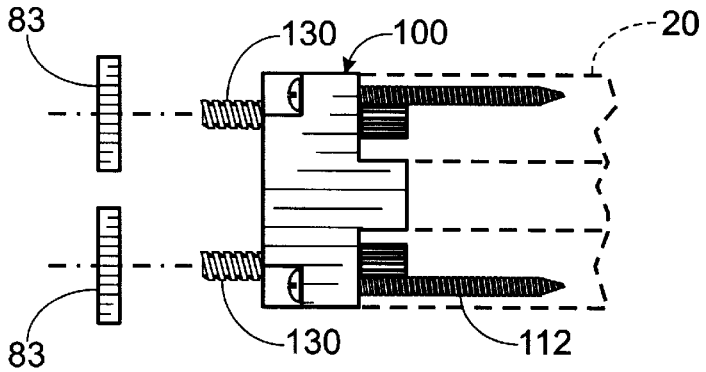
Figure 8:
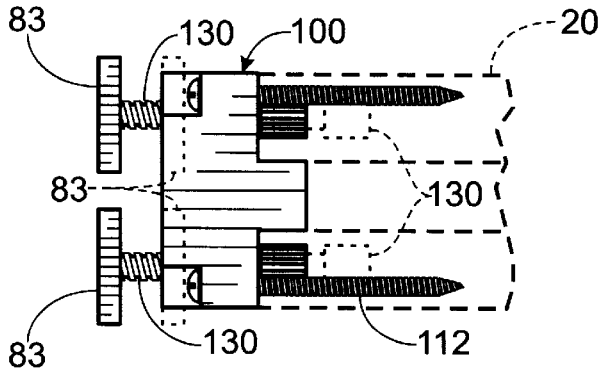
Figure 9:
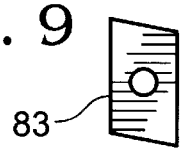
FIGS. 9 and 10 are a plan and side view, respectively, of a channel nut that is useful for both connecting together studs and for securing items to the batten.
Figure 10:
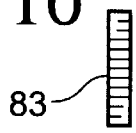

A channel nut 83 (shown in plan, FIG. 9 and side, FIG. 10) is threaded to the exposed end of each screw 130 (FIG. 5). As such, the assembly of the horizontal stud 102 and connector block is ready for joining to a vertical stud 20. FIGS. 6–8 show in a sequence of three drawings how a connector block 100 of the present system is connected to the end of a stud and readied for connection with another stud by locating the cap screws 130 and threading the channel nuts 83 onto the shafts of the screws.

Figure 11:
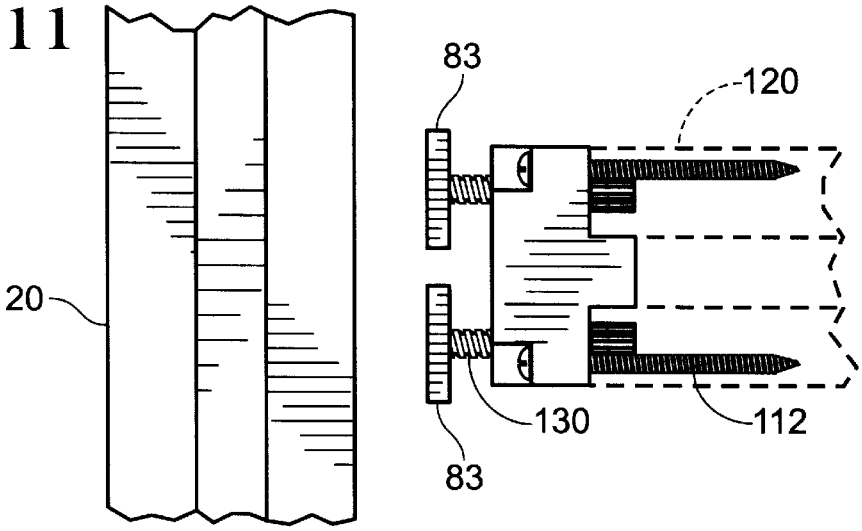
FIGS. 11–13 show in a sequence of three drawings how one stud is connected with another stud that is oriented perpendicular to the first stud.
Figure 12:
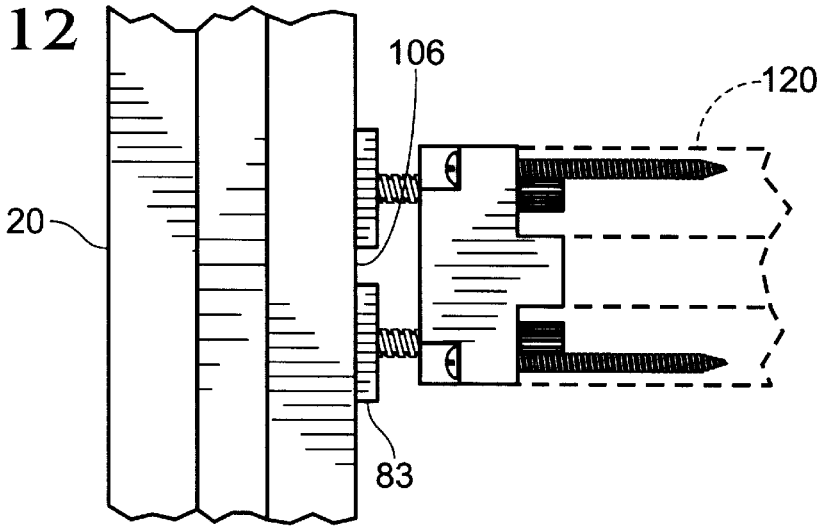
Figure 13:
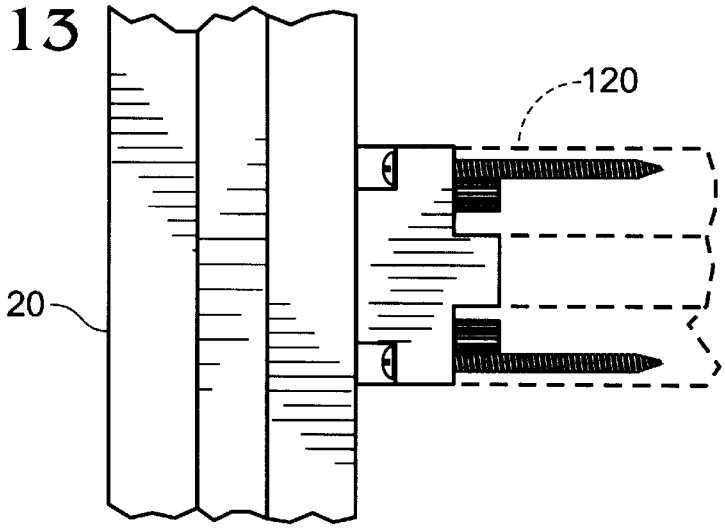

The channel nuts 83 are rotated by an amount sufficient to permit them to pass through the slot 34, thereby to be inserted in the chamber 40 of the stud 20. (The nuts 83 in the right half of FIG. 5 are shown prior to such rotation.) Once inserted, the nuts are rotated until they bear against the shoulders 46, whence the screws 130 are tightened to complete the connection (See FIGS. 4 and 13). FIGS. 11–13 are a sequence of three drawings showing the just described method of connecting one stud 120 with another stud 20 that is oriented perpendicular to the first stud.

The batten 60 and stud 20 are sized so that a single size of channel nut 83 can be used both for connecting studs (as just described) and for connecting items to the batten. With respect to the latter, FIG. 4 shows a channel nut 83 fit into the batten, ready to receive the end of a threaded fastener that may be used, for example, to connect a shelf to a wall panel.

It is noteworthy here that the recess 106 in the connector block 100 is sized to receive the channel nuts 83 that are threaded on the screws 130. In this regard, the nuts may be retracted into the recess 106 so they do not protrude from the block. This retracted position is shown in dashed lines of FIG. 8. It will be appreciated that the retraction feature reduces clearance requirements during assembly (since an unconnected beam and connector block assembly is not longer than a connected beam and connector block assembly) and, thus, greatly facilitates moving, for example, a horizontal stud into position between two fixed vertical studs prior to joining the horizontal stud to them.

As noted earlier, a pair of connector blocks may be employed for splicing together two axially aligned studs, such as two parts of a vertically oriented stud. The splicing aspect of the connector block enables simple construction and remodeling of wall systems in instances where only a portion of the wall between the ceiling and floor need be changed.

Figure 14:
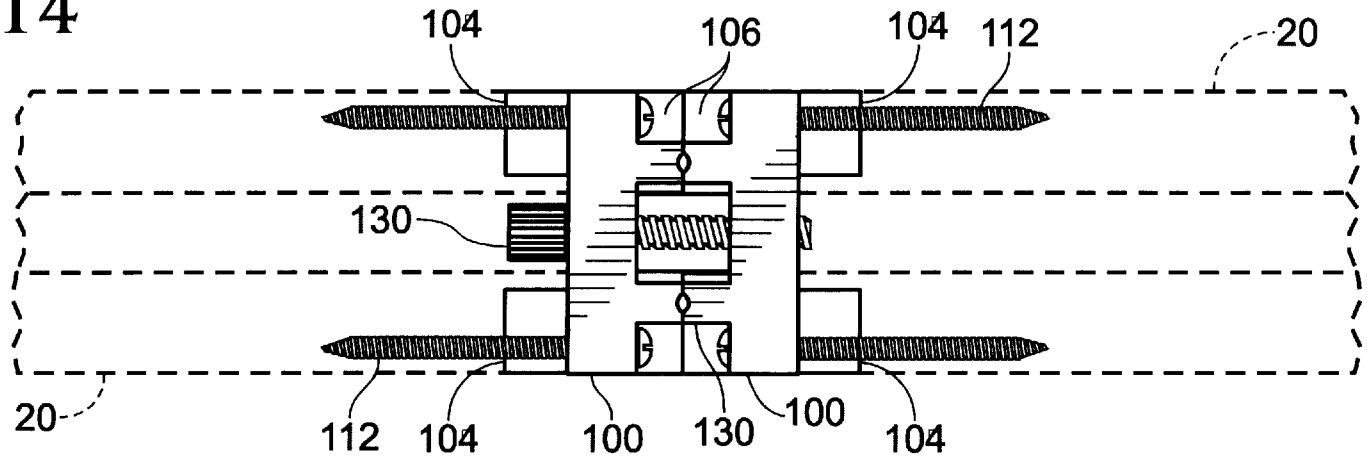
FIG. 14 is a side view of a pair of studs that are spliced together in accordance with the present invention.

As shown in FIGS. 14 and 15, this splicing is accomplished by abutting together the ends of two studs 20 that have connector blocks 100 fastened to them in the manner described above. In one embodiment, one of the blocks is modified by threading the normally clear holes 129. Once the studs are aligned, the screws 130 passing though one block are threaded into the correspondingly threaded holes on the other block to fix the junction. The screws 130 may have Allen-type heads so that they are tightened with an Allen wrench that fits through the adjacent slot 34 in the stud.

While the present invention has been described in terms of a preferred embodiment, it will be appreciated by one of ordinary skill that modifications may be made to alter or supplement the components.

For example, FIG. 5 shows the connection of a narrow side of a vertical stud to the narrow side of the horizontal stud, along with a suitable connector block. A substantially similar connector block would be used in instances requiring the connection of wide side of a vertical stud to the wide side of the horizontal stud. Such a block, however, would be modified slightly so that the recess 106 extends parallel to the short sides of the block. The protrusions 104 would be realigned accordingly, to fit into the appropriate chamber in the stud.

FIG. 18 is an end view of a stud component of a wall system formed in accordance with an alternative embodiment of the present invention. That stud 220, in many respects (such as its universal side widths) is substantially similar to the stud 20 of FIG. 1. The last two digits of the three-digit reference numbers applied to FIG. 18 correspond to the reference numbers of similar components as described in connection with FIG. 1.

The embodiment of FIG. 18 includes, as compared to FIG. 1, more metal in the corners 227. The apertures 248 are spaced about one-diameter's length from the outer corner walls of the stud. This, along with thickened horizontal and vertical parts (that is, horizontal and vertical as viewed in FIG. 18) of the inner walls 236, 238 enhances the stud's resistance to deflection along its length.

Figure 19:
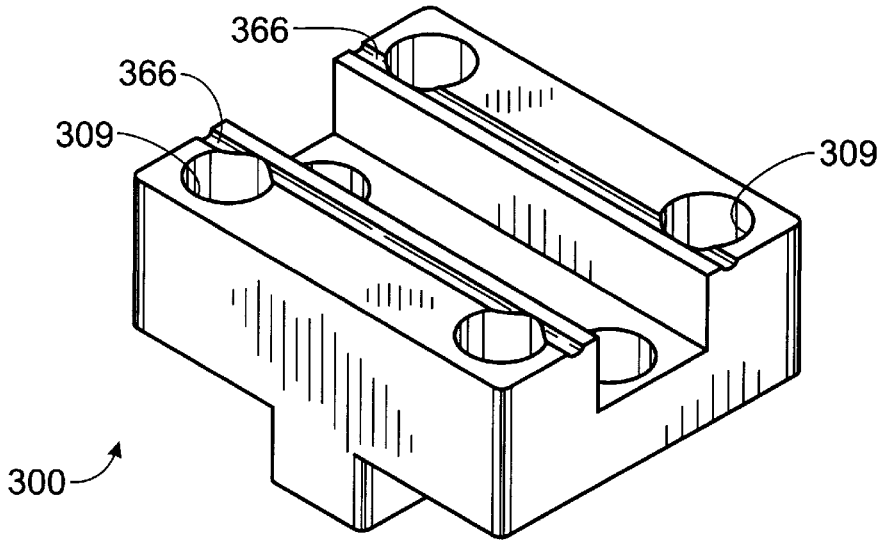
FIG. 19 is a perspective view of one side of a connector block configured for use with the alternative stud embodiment of FIG. 18.

FIG. 19 shows one side of a connector block 300 that is used with the stud embodiment of FIG. 18. This block substantially matches the block 100 described above, but for the region surrounding the holes 309 for the sheet metal screws. Those holes 309 are centered with apertures 348, which, as noted, are more distant from the corners of the stud 220. As a result, the holes 309 are countersunk into the surface 310 of the block, thereby obviating the need for the cubical cut 108 described above. The heads of the sheet metal screws 112 will reside substantially out of view in the countersunk portion of the holes 309.

Figure 20:
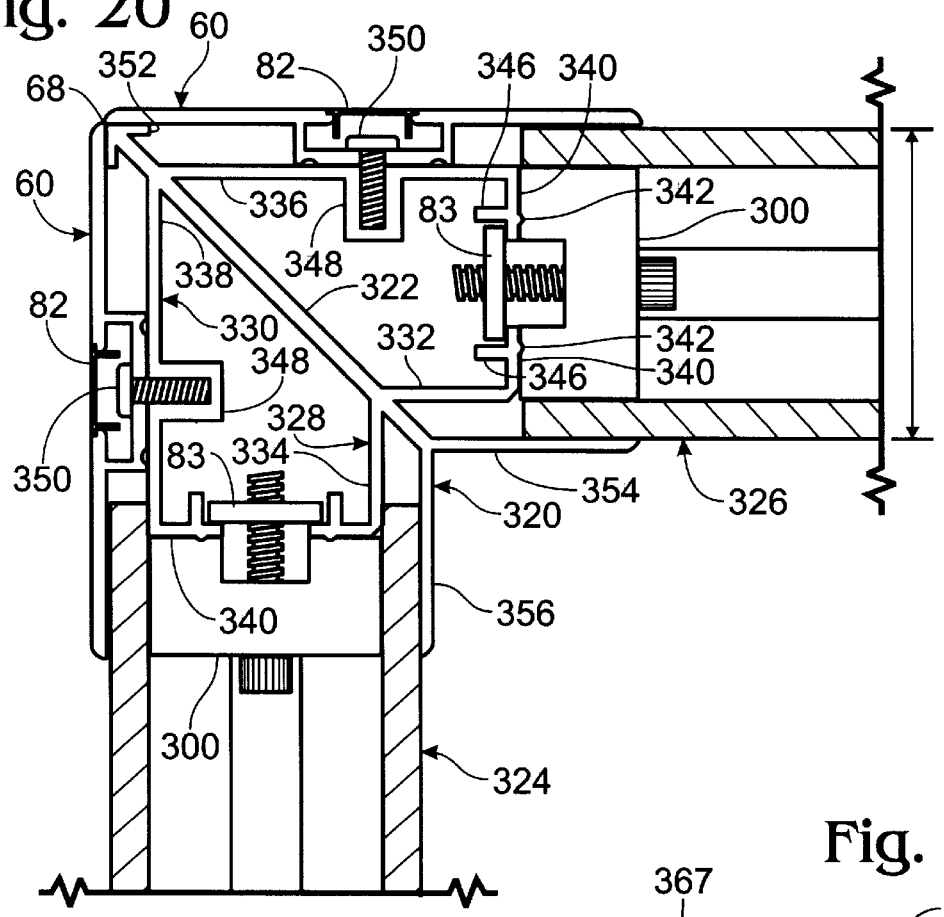
FIG. 20 is an end view of a corner stud component of a wall system of the present invention.
Figure 21:
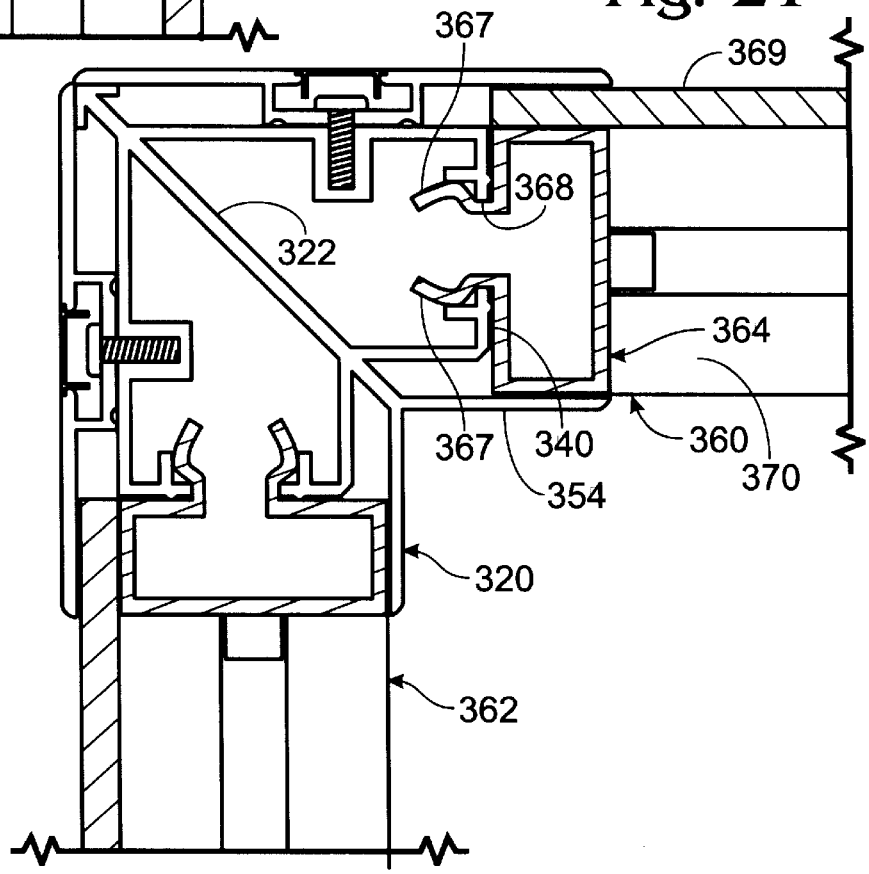
FIG. 21 is another end view of a corner stud component of a wall system of the present invention.

FIGS. 20 and 21 show an end view of a corner stud 320 that is designed for use with the present system. Referring first to FIG. 20, the corner stud 320 includes a planar web 322 that extends through the corner stud. The web is integrally formed (as by extrusion) with the remaining parts of the stud and is angled 45° relative to the perpendicular walls 324, 326 that are joined by the corner stud 320.

The corner stud 320 also includes an inner angle member 328 and outer angle member 330. The inner angle member is a generally 90° angle member having its vertex at the junction of that member and the web 322. The inner angle member is thus divided into two perpendicular parts, one part 332 extending toward one joined wall 326 and the other part 334 extending toward the other joined wall 324.

The outer angle member 330 is a generally 90°-angle member having its vertex at the junction of that member and the web 322. The outer angle member is thus divided into two perpendicular parts, one part 336 extending toward one joined wall 326 and the other part 338 extending toward the other joined wall 324.

The ends of the inner angle part 332 and outer angle part 336 away from the web are formed into a side wall 340 having a central slot and against which a connector block 300 (FIG. 19) may be fastened. To this end, the side wall is provided with a pair of ridges 342 that mate with the grooves 366 in the connector block. Inside the side wall 340 on opposite sides of the slot the respective ends of the outer angle part 336 and inner angle part 332 are provided with shoulders 346. As described above with respect to the other studs, the shoulders 346 provide a bearing surface for the channel nuts 83 to permit fastening of the connector block 300 to the corner stud 320 via the screws 130.

The ends of the other parts 334, 338 of the inner and outer angle members are shaped to match those just described to enable attachment of a connector block 300 associated with the other wall 324.

As respects the outer angle member 330, each part 336, 338 includes a recessed part 348 that includes two parallel portions, the facing surfaces of which are corrugated to receive a threaded fastener 350. That fasteners 350 extend through the spaced-apart holes in the above-described battens 60 to secure the battens to the perpendicular parts 336, 338 of the outer angle member 330. As described above, the slot in the batten may be closed with a cover 82.

The joined, rounded edges of the flanges 68 of the battens 60 are supported by a protrusion 352 of the web 322. This protrusion extends from the vertex of the outer angle member 330 and terminates in a 90° arrowhead configuration, against which seat the edges of the batten flanges 68.

The web 322 also protrudes inwardly from the vertex of the inner angle member 328 and defines an angled flange member having one part 354 that extends toward the wall 326 parallel with the edge of the flange 68 of the batten that is mounted to the outer angle member 330. The space between that flange 68 and the web flange part 354 conforms to the above described nominal wall thickness of two inches (5.08 cm). As a result, the walls 324, 326 joined by the corner stud 320 may be in any of the three wall configurations as described above (the "double sided wall' being depicted in FIG. 20).

FIG. 21 is a view of the corner stud 320 showing the connected walls 360, 362 oriented in the "single sided wall" arrangement mentioned above. The view of FIG. 21 also varies from the view of FIG. 20 inasmuch as the view of FIG. 20 shows the joined walls 326, 324 in a section view taken adjacent to the connector block 300. FIG. 21, however, shows the joined walls 360, 362 in a section view taken at a location away from the connector block and across a liner 364, which is described next.

The liner 364 is an elongated, plastic member that has a generally box-shaped cross section. The liner 364 is useful for covering the side wall 340 of a corner stud 320 (or for covering the side wall of any stud 20, 220). In this regard, one side of the liner is opened and formed into two curved tabs 367. The outermost ends of the tabs 367 fit through the slot 368 in the side wall 340. As the liner is pushed against the side wall 340, the tabs are deflected toward one another and then resile once the relatively narrow junction of the tabs and liner reaches the slot 368. As a result, the resiliency of the tabs 367 secures the liner 364 against the wall 340 as shown in FIG. 21.

The liner 364 depicted in FIG. 21 is shaped to fit between the wall panel 369 and the flange part 354 of the web 322. The liner is in place on the vertically oriented corner stud 320 between connections with any horizontal studs, such as shown at 370 in FIG. 21. In this arrangement, the liner resists inward deflection of the panel 369 relative to the corner stud 320. It will be appreciated that the liner may also be shaped as needed to fit any other wall configuration.

Figure 22:
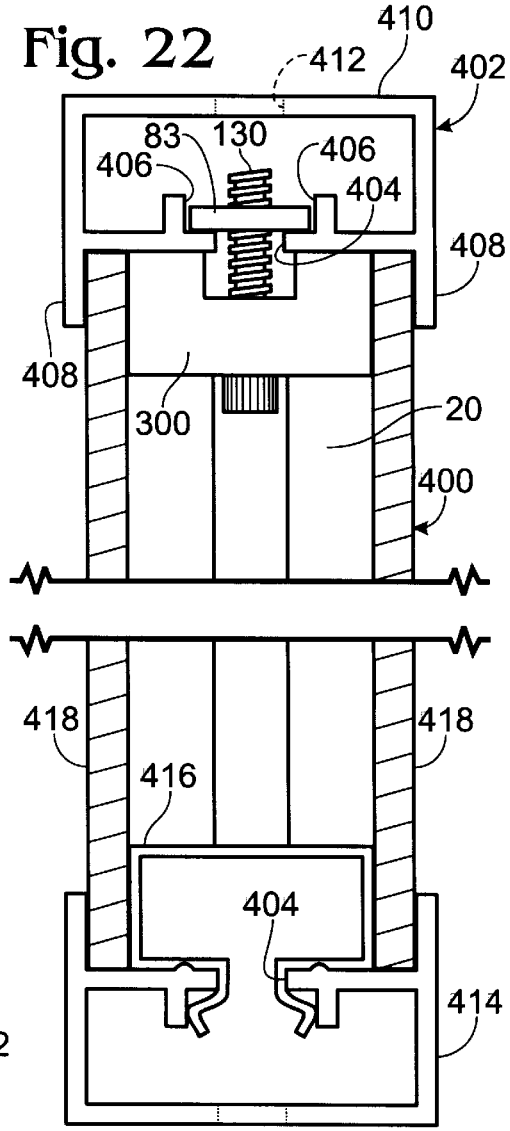
FIG. 22 is an elevation view showing top and bottom track components of the wall system of the present invention.

FIG. 22 shows an elevation view of a vertical, double sided wall 400. The top of the wall is covered with an elongated top track 402. The top track is a rigid, generally box-shaped member that includes a central slot 404 in the lower one of two horizontal walls. Inside that slot 404, there are formed shoulders 406. The shoulders 406 provide a bearing surface for a channel nut 83 to permit fastening of a connector block 300 (which is carried on the end of a vertically oriented stud 20) to the top track 402 via screws 130.

The side walls of the top track include extensions 408 that are spaced apart by an amount corresponding to the nominal wall thickness. The top of the wall 400 fits between the extensions. The upper horizontal wall 410 of the top track 402 includes spaced-apart through (unthreaded) apertures 412 to facilitate connection with a ceiling grid or other structure as described more below.

In keeping with the universal nature of most of the components of the present invention, a bottom track 414 for covering the bottom of a wall 400 is identical in construction to the top track, but inverted for use. The section of the wall 400 at the bottom track 414 is taken at a location (i.e., away from a connector block 300) to illustrate another liner embodiment 416 used here to cover the slot 404 in the bottom track 414 between connector blocks, and to resist inward deformation of the wall panels 418.

Figure 23:
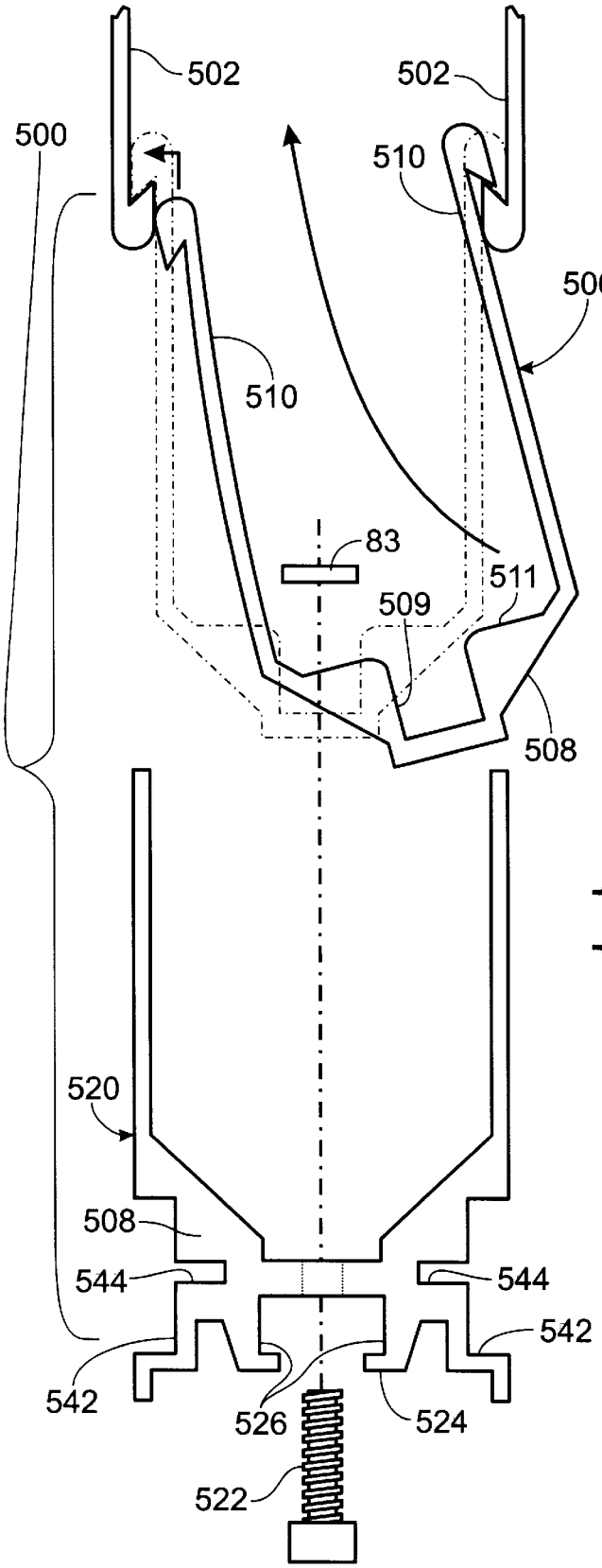
FIG. 23 is an end view of the two primary deflection track components of the wall system of the present invention.
Figure 24:
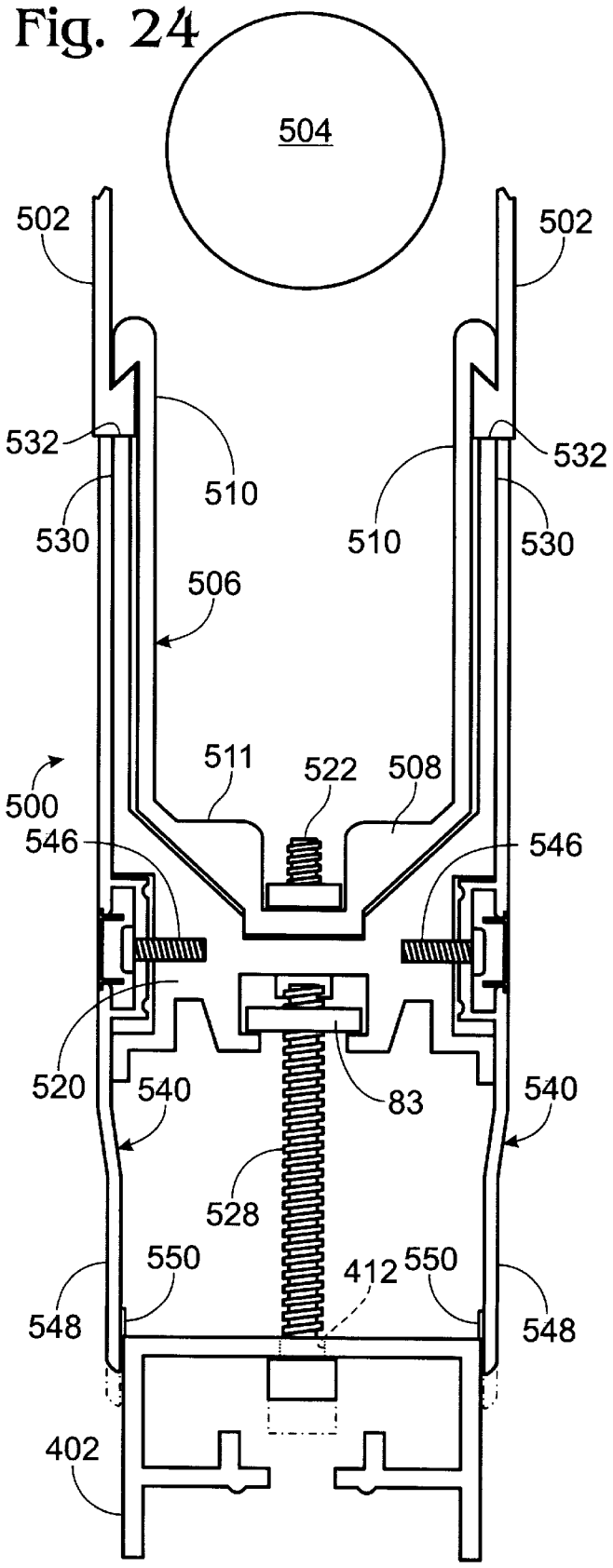
FIG. 24 is an end view showing the assembled and connected deflection track components of the wall system of the present invention.

In some instances it is desirable to connect the top track 402 of a wall to a ceiling grid in a manner that permits relative movement (slight deflection) of the ceiling grid relative to the wall. To this end, there is provided in the present system a deflection track assembly, the particulars of which are illustrated in FIGS. 23–24.

The deflection track assembly 500 is for connecting the top track 402 of a wall to a ceiling grid. The ceiling grid includes a pair of downwardly extending prongs 502 that, although subject to some vertical deflection (as vertical is considered in FIGS. 23 and 24) are rigid and substantially immovable toward or away from one another. Between and above the prongs 502 there may be attached to the ceiling grid a fixture, such as a light 504, for which occasional access is desired.

The deflection track assembly includes a clip 506 that is a generally U-shaped member having a body 508 from which extend two legs 510. The legs 510 end in hooks that conform to the shape of the ceiling prongs 502. The clip 506 is simply attached to the prongs 502. This attachment is a snap fit, whereby the hooked end of one of the legs 510 is moved between the prongs 502, near one of the prongs (FIG. 23), after which the hooked end of the other leg 510 is pressed upwardly against the rounded underside of the other prong 502 to slightly squeeze together the legs 510 until the hooked ends of both legs fit between and engage the ceiling prongs. Thus, the one-piece clip 506 is attached without the use of tools.

Once the clip 506 is in place (i.e., hooked to the prongs 502), a generally U-shaped base member 520 is attached to the clip. The base member 520 is fastened to the clip by a fastener 522. In this regard, the bottom 508 of the clip includes a recess 509 in which resides the shaft of the fastener 522. Thus, the fastener 522 does not protrude above the upper surface 511 of the clip bottom 508.

The base 520 includes a bottom side 524 that is shaped to include a pair of shoulders 526. The shoulders 526 provide bearing surfaces for a channel nut 83 to permit fastening of the top track 402 to the base 520 via an elongated screw 528 (FIG. 24). (Screw 528 is not vertically aligned with the clip screw 522).

The legs 530 of the base 520 fit alongside of the clip legs 510 and are of a length such that the ends 532 of the legs 530 bear against the ceiling prongs to capture those prongs between the legs 530 and the hooked ends of the clip legs 510. Thus, the attachment of the base 520 to clip 506 also locks together the engaged prongs and hooks.

As noted, the aperture 412 in the top track 402 is not threaded. Thus, in the event the ceiling grid is deflected downwardly (this deflection being transferred to the screw 528 via the connected clip and base), the head end of the screw is free to travel relative to the otherwise stationary top track 402 and wall, as shown by the dashed lines in FIG. 24.

Figure 25:
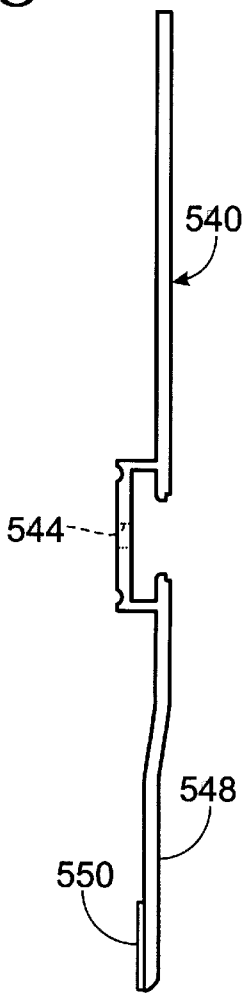
FIG. 25 is an end view of a batten that is useful in connection with the deflection track components.

The base 520 is configured to carry battens 540 that close the changeable gap between the top track 402 and base 520. In this regard, the opposite sides of the base are formed with recessed channels 542 (FIG. 23) that are continuous with a central, corrugated slot 544. The batten base 544 (see FIG. 25) fits into the channel and is fastened there via a screw 546 as shown in FIG. 24. Preferably, one of the flanges 548 is bent inwardly slightly to ensure a snug engagement with the side wall of the top track 402. The part of that flange 548 that contacts (hence, occasionally slides against) the top track 402 may be covered with low-friction material 550 such as a polytetrafluoroethylene-coated tape. The other flange of the batten, like the ends 532 of the legs 530, bears against the ceiling prongs to enhance the capture of those prongs between the legs 530 and the hooked ends of the clip legs 510.

It is noteworthy that the length of the deflection track assembly 500 (as measured normal to the plane of FIG. 24) is selected to be short (for example, 2 inches), and a number of such spaced apart assemblies are employed for connecting the top track 402 to the ceiling grid as just described. This sizing and spacing permits easy access to ceiling fixtures and the like because once one or both battens 540 are removed, there is sufficient clearance between any two assemblies 500 and between the top track 402 and ceiling prongs 502. For instance, a light fixture 504 can be replaced without the need to disconnect the deflection track assembly from either the ceiling grid or the top track.

In view of the variations and modifications appreciable to one of ordinary skill, the invention is considered to be that described in the language of the appended claims and equivalents.

What is claimed is:

1. A stud and batten system for a cleanroom wall comprising:

a stud having a generally rectangular cross section defined by opposing wide sides that are wider than opposing narrow sides of the stud; and a batten having a base, a first portion of the base being attachable to one of the narrow sides and to both of the wide sides, the based also having a pair of walls extending outwardly from the first portion; the batten also having flanges, one flange protruding from each of the walls and spaced away a gap distance from the first portion and thus defining a gap between the flanges and the side of the stud to which the first portion of the base is attached.

2. The system of claim 1 wherein the stud and batten are sized so that the combined width of one of the wide sides of the stud and of the gap distance matches the combined width of one of the narrow sides of the stud and twice the gap distance.

3. A stud and batten system for a cleanroom wall comprising:

a stud having a generally rectangular cross section defined by opposing wide sides that are wider than opposing narrow sides of the stud;

a batten having a base, a first portion of the base being attachable to one of the narrow sides and to both of the wide sides, the base also having pair of walls extending outwardly from the first portion; the batten also having flanges, one flange protruding from each of the walls and spaced away from the stud and defining a gap between the flanges and the stud; and a wall panel that fits into the gap between the flanges and the stud.

4. The system of claim 1 including mating means formed on the stud and batten to facilitate attachment of the batten to the stud.

5. A stud and batten system for a cleanroom wall comprising:

a stud having a generally rectangular cross section defined by opposing wide sides that are wider than opposing narrow sides of the stud;

a batten having a base, a first portion of the base being attachable to one of the narrow sides and to both of the wide sides, the base also having a pair of walls extending outwardly from the first portion; the batten also having, one flange protruding from each of the walls and spaced away from the stud and defining a gap between the flanges and the stud; and mating means formed on the stud and batten to facilitate attachment of the batten to the stud, the mating means including a pair of elongated grooves formed in the batten and a mating pair of ridges formed in the stud.

6. The system of claim 1 wherein the stud includes at least three pairs of corrugated surfaces for receiving threaded fasteners therein.

7. A stud and batten system for a cleanroom wall comprising:

a stud having a generally rectangular cross section defined by opposing wide sides that are wider than opposing narrow sides of the stud; and a batten having a bass, a first portion of the base being attachable to one of the narrow sides and to both of the wide sides, the base also having a pair of walls extending outwardly from the first portion; the batten also having flanges, one flange protruding from each of the walls and spaced away a gap distance from the first portion and thus defining a gap between the flanges and the side of the stud to which the first portion of the base is attached, the system including a slot formed in each of the opposing wide and narrow sides of the stud, and wherein the batten base first portion is wider then the slot.

8. The system of claim 7 wherein the slots are formed to have recessed edges, thereby to accommodate a cover member fit into the slot and flush with a surface in the stud in which the slot is formed.

9. A stud and batten system for a cleanroom wall comprising:

a stud having a generally rectangular cross section defined by opposing wide sides that are wider than opposing narrow sides of the stud; and a batten having a base, a first portion of the base being attachable to one of the narrow sides and to both of the wide sides, the base also having a pair of walls extending outwardly from the first portion; the batten also having flanges, one flange protruding from each of the walls and spaced away a gap distance from the first portion and thus defining a gap between the flanges and the side of the stud to which the first portion of the base is attached and wherein the stud cross section includes chambers, and further comprising a connector block fastened to one end of the stud to facilitate connection of one stud to another, the connector block having integral protrusions that fit snugly into the chambers in the stud end to which the block is fastened.

10. A connector block assembly for a cleanroom wall system, wherein the system includes connected studs, the assembly comprising:

a block having a body that has a cross section that is sized to match the cross section of a stud;

the body including a pair of protrusions that protrude from a first side of the body to fit into the end of the stud to which the block is connected; and fasteners extending through the body for fastening the block to the end of the stud.

11. The assembly of claim 10 wherein the body fits between two connected studs and includes:

an elongated recess formed in a second side of the connector body that is opposite the first side;

holes to accommodate screws such that the shafts of the screws extend into the block recess; and channel nuts threaded to the shaft of each screw; wherein the recess in the body is sized to receive the channel nuts that are threaded on the screws so that nuts may be retracted into the recess and not protrude from the block body, the screws being irremovable from the body unless the nuts are unthreaded from the shafts.

12. The assembly of claim 11 wherein the body includes mating means formed on the connector block to facilitate attachment of the block to a stud.

13. The assembly of claim 10 further comprising two blocks as defined in claim 10 and fastened together to abut each other so that the protrusions of one block protrude in a direction opposite the protrusions of the other block, thereby to facilitate splicing together ends of two studs.

14. A method of making a connector block for attachment to the end of a stud that has a cross section that includes chambers, the method comprising the steps of:

forming each block to have a cross sectional size that matches the cross sectional size of the stud;

providing fastener apertures in each block to receive fasteners for attaching the block to an end of a stud; and forming protrusions on one side of the block to fit into the chambers, thereby to stiffen the connection between the block and the stud when the stud and block are attached.

15. The method of claim 14 including the step of defining a recess in the side of the block that is opposite the side from which the protrusions are formed.

16. The method of claim 14 including the step of forming the block with threaded apertures arranged to permit fastening together two such blocks so that the protrusions of one of the fastened blocks protrude in a direction opposite the direction of the protrusions of the other fastened block.

* * * * *